United States Patent [19]

Malherbe

[11] Patent Number: 5,008,993

[45] Date of Patent: Apr. 23, 1991

[54] METHOD OF MAKING SURFACE FINISHING ROLLERS AS WELL AS A ROLLER MADE THEREBY

[75] Inventor: Bent Malherbe, Espergaerde, Denmark

[73] Assignee: Sony Corporation, Tokyo, Japan

[21] Appl. No.: 527,386

[22] Filed: May 23, 1990

[51] Int. Cl.[5] ..... B24B 9/02

[52] U.S. Cl. ..... 29/125; 29/895.21; 29/895.213; 29/121.1; 51/334

[58] Field of Search ..... 29/895.213, 125, 121.1; 51/331, 332, 334, 335, 336, 352; 15/320, 321, 383

[56] References Cited

U.S. PATENT DOCUMENTS

| | | | |
|---|---|---|---|
| 2,476,537 | 7/1949 | Erickson | 15/383 |
| 4,637,173 | 1/1987 | Hundebol | 51/334 |
| 4,850,158 | 7/1989 | Schaffner | 51/334 |

*Primary Examiner*—Timothy V. Eley
*Assistant Examiner*—R. Martin
*Attorney, Agent, or Firm*—Lewis H. Eslinger

[57] ABSTRACT

Surface finishing or polishing rollers are made by successively mounting disk-shaped surface finishing elements on a spindle rotating in operation. The surface finishing elements are formed of a slitted, preferably rectangular sheet having a continuous portion of material with lamellae protruding perpendicularly therefrom. The slitted sheet is shape-fixed with binder, and the periphery of the protruding lamellae forms an ellipse. The surface finishing elements, each of which comprises an oval disk with lamellae, are mounted inclined on the shaft of the spindle so that the contour of the successively mounted surface finishing elements forms a cylinder in the axial direction of the spindle.

7 Claims, 5 Drawing Sheets

METHOD OF MAKING SURFACE FINISHING ROLLERS AS WELL AS A ROLLER MADE THEREBY

Figure 1:
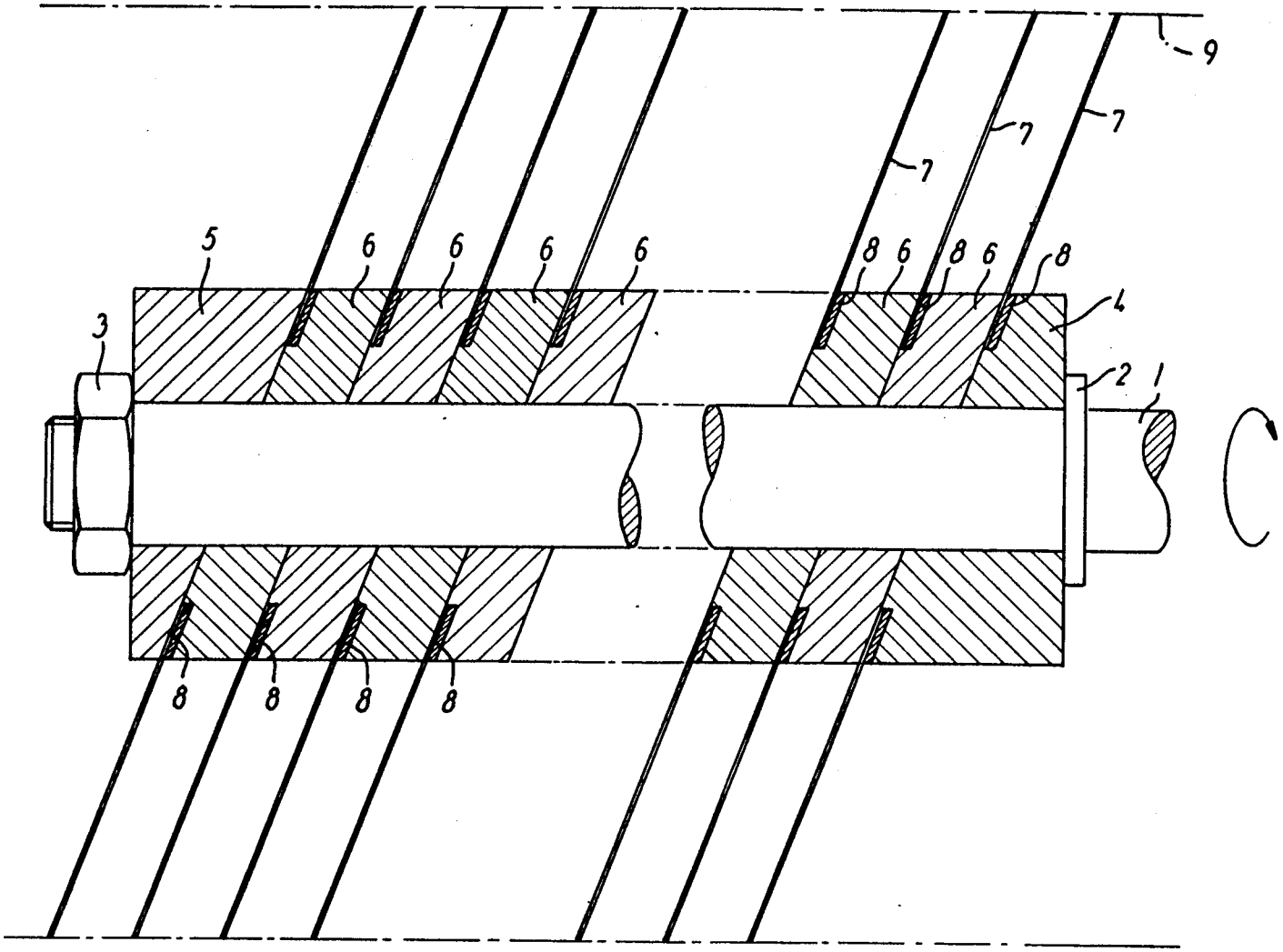

The present invention concerns a method of making surface finishing or polishing rollers comprising disk-shaped sanding elements, which are arranged successively on a spindle rotating in operation, each of said sanding elements being formed by a slitted, preferably rectangular sheet, which is provided with abrasive as required and has a continuous portion in one direction with perpendicularly protruding lamellae thereon. The invention moreover concerns a surface finishing or polishing roller of the type used for working surfaces, during which operation the roller is caused to rotate about its own axis and to move in parallel with the surface.

The above-mentioned type of surface finishing rollers is used e.g. in the furniture and wood industry where they are employed for working wood surfaces, such as table tops, panelled doors and the like. A plurality of surface finishing rollers or sanding spindles on a surface finishing machine is caused to rotate about their own axis while being moved across the surface for working. A plurality of examples of such surface finishing rollers is known, where e.g. the Danish Published Application DK 149281 describes a sanding roller made of a plurality of slitted, double-layered sanding disks which are arranged around a shaft so that the disks form lamellae protruding radially therefrom. The rollers formed hereby have a serious drawback since the individual sanding rosettes attack the workpiece which is being worked, which takes place in a direction at right angles to the rotating shaft. One reason is that it is difficult for the lamellae in a double-layered disk to turn according to the contours of the wood, which is a problem in particular when the lamellae on such a sanding disk perpendicularly hit a sharp edge on the workpiece. The lamellae of the disk then tend to make cuts in the edge or to remove an accessive amount of the soft portions, while the harder portions of the wood are left, which imparts a disuniform surface to the wood, where even plane faces have a structured feel.

When used for working surfaces the sanding rollers of the prior art are vitiated by a marked drawback since they are not able to break the edges of a workpiece when these edges are perpendicular to the axis of rotation of the rollers. It has e.g. been attempted to compensate this by mounting the sanding rollers on a so-called carousel machine, which, in addition to rotating the rollers, also causes them to perform a rotary motion about an axis which is orthogonal to the plane of the workpiece.

A plurality of constructive initiatives in connection with carousel machines have been made to overcome this very disfortunate property, it having e.g. been attempted to compensate for the tendency to sanding tracks by turning the direction of rotation of the rollers, e.g. in that pairs of spindles permanently run in opposite directions. The sanding track compensation attempted with these machines is not achieved to a sufficient degree, the reason being that the rotary speed of the spindles is considerably greater than the other turning motions. Further, the complexity of the machines is increased considerably without any simultaneous, satisfactory reduction of the drawbacks in the form of the previously mentioned sanding track.

The object of the invention is to provide a method of making a surface finishing or polishing roller which is not vitiated by the drawbacks of the prior art by making surface finishing tracks or cuts in edges which are parallel with the shaft of the roller, while edges at right angles to the shaft of the roller are broken in a very imperfect manner.

This object is achieved by the method stated in claim 1, which provides a surface finishing roller consisting of successively arranged surface finishing disks which are inclined with respect to the shaft of the roller. The advantage is that a roller made according to the method will oscillate during rotation, whereby the surface finishing properties are improved.

The invention moreover concerns a surface finishing or polishing roller of the previously mentioned type, which is characterized in that it comprises a plurality of surface finishing elements, which are inclined about its axis and which, in a preferred embodiment, comprise oval, slitted surface finishing disks. This structure entails that the point of attack of the individual disks on the workpiece for working during rotation of the roller describes an oscillating or reciprocal pivotal movement, thereby effectively eliminating the problems of tracks since the impacts on the workpiece perpendicular to the shaft of the roller are distributed over a greater angular area, whereby the effectiveness of the surface finishing is improved. Thus, it is ensured with the oscillating surface finishing disks that even the edges perpendicular to the shaft of the rollers are broken sufficiently, since the oscillating motion ensures that the major part of the sanding lamellae is moved over the edge of the workpiece forming an angle with it and are not just moved in parallel past it, as is the case with the prior art.

Loose fibers are removed from the surface of the wood by fine sanding, which is done after a more rough sanding, but before the wood is varnished. Normally, the fibers are oriented because of the structure of the wood and cannot therefore be removed completely with the prior art with a single passage of the roller, since some of the fibers will merely lay down. With the roller of the invention, the fibers will be attacked from changing directions whereby the loose fibers are torn loose. It has been observed that the surface finishing roller of the invention exhibits a considerably improved ability to remove more "loose" fibers than has been possible with the prior art.

Figure 2A:
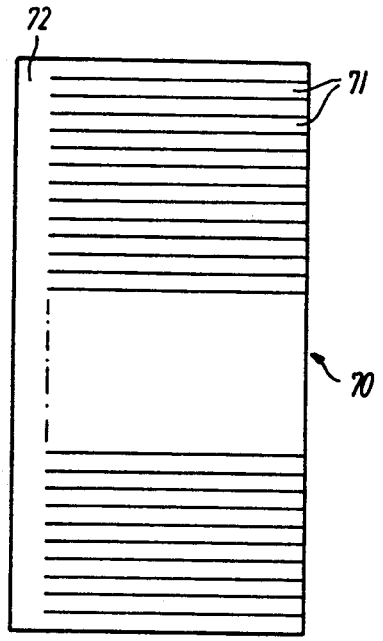
Figure 2B:
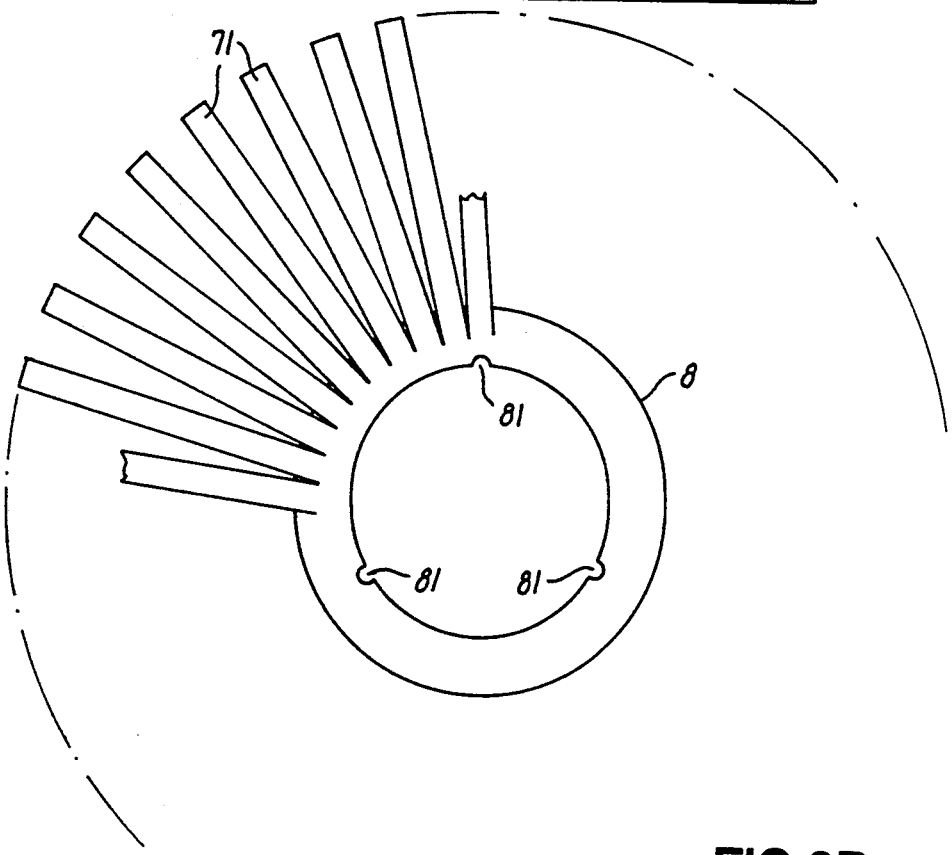
Figure 3A:
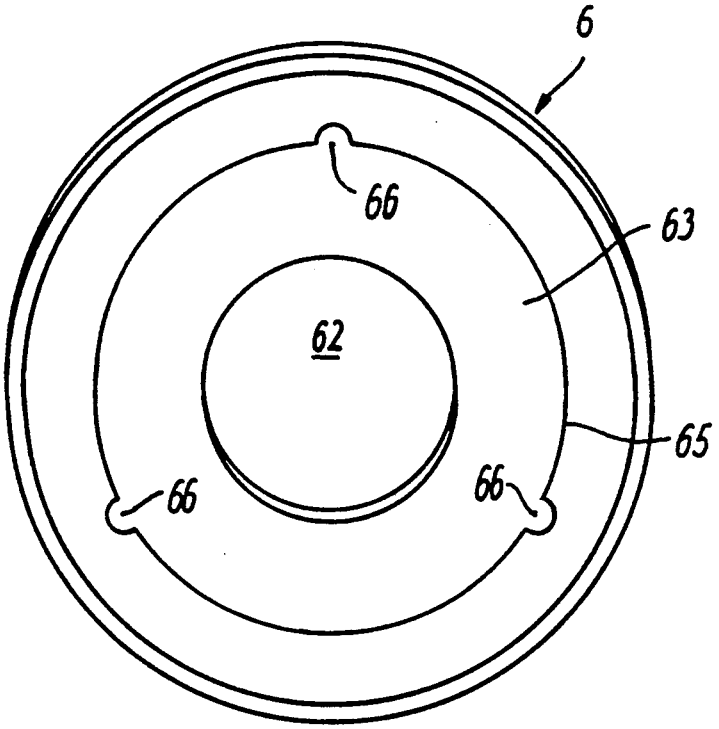
Figure 3B:
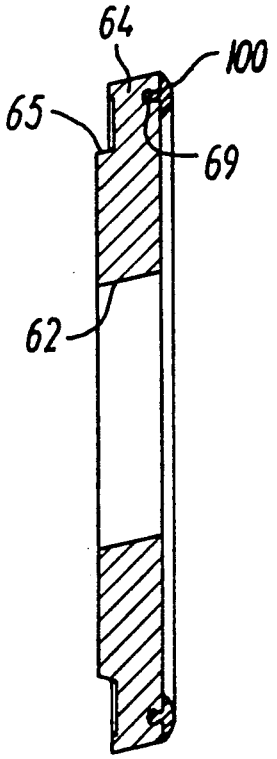
Figure 4:
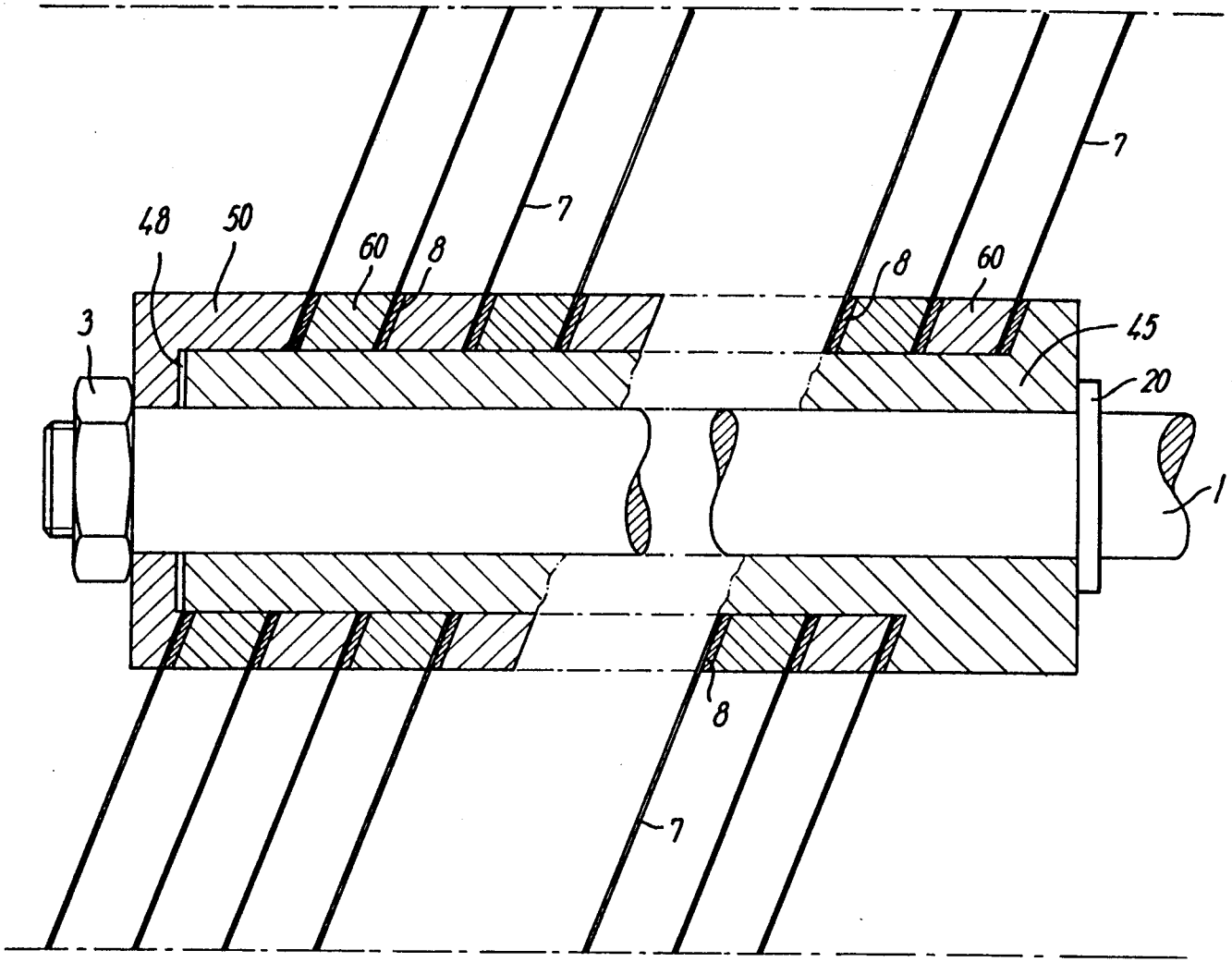
Figure 5:
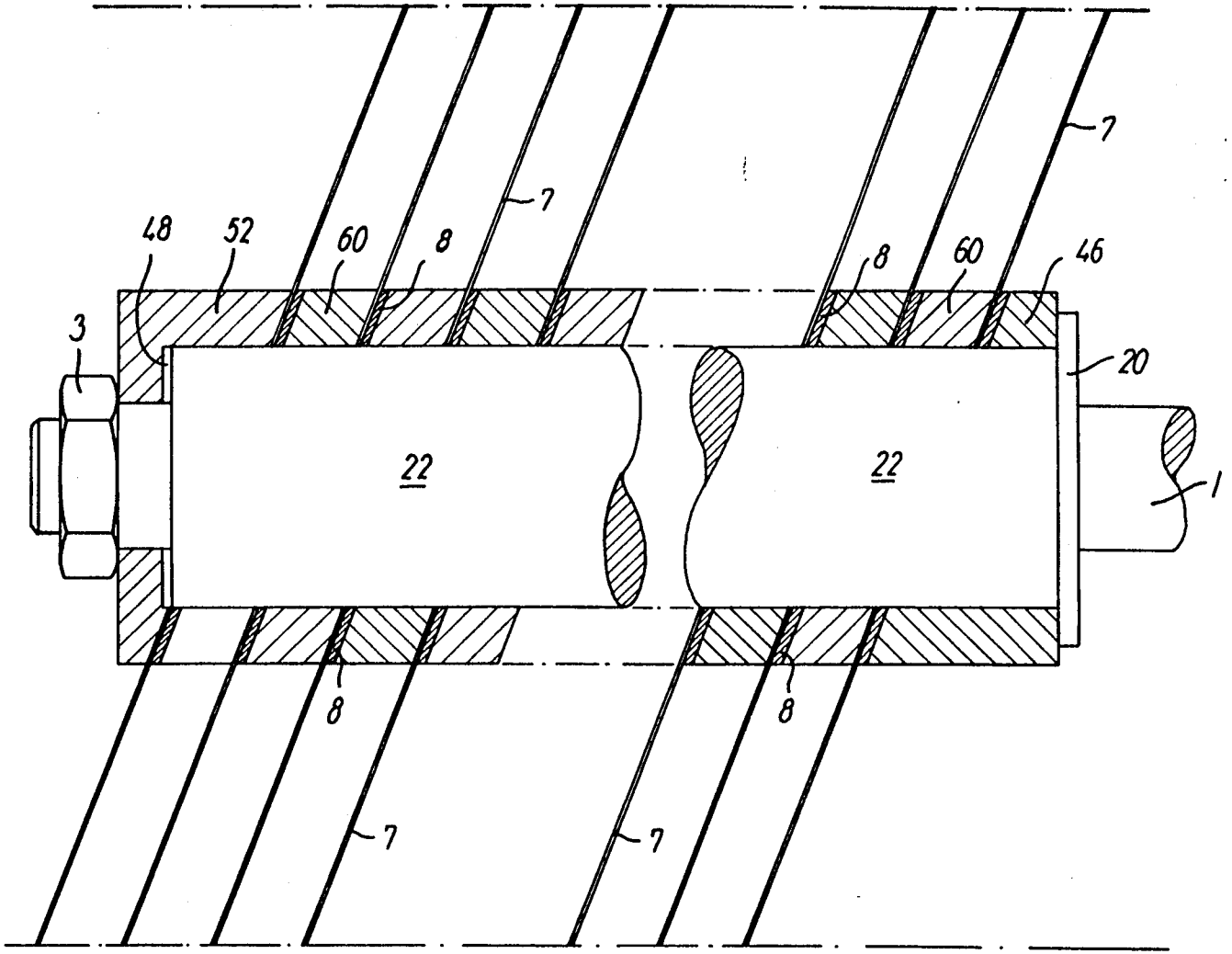

The invention will be explained more fully below with reference to the drawing, in which FIG. 1 shows a cross-section of a preferred embodiment of a sanding roller according to the invention, FIG. 2A shows a starting material for making a sanding element, and FIG. 2B shows how material is placed on a carrier disk, FIGS. 3A and 3B are a front view and a lateral view of the structure of a spacerring shown in FIG. 1, FIG. 4 shows a cross-section of an alternative embodiment of a sanding roller according to the invention, and FIG. 5 shows a cross-section of an additional embodiment of a sanding roller according to the invention.

FIG. 1 shows a preferred embodiment of a surface finishing or sanding roller according to the invention, where the roller shown in FIG. 1 together with a plurality of other rollers is mounted on a sanding machine adapted to move the rotating sanding rollers over the workpiece for working. A shaft 1 is shown cut, but continues inwardly toward the drive member of the sanding machine, where power transfer known per se takes place. The shaft 1 is provided with an annular collar 2, which, when clamped with a bolt 3 on a threaded part in the outer end of the shaft, serves as a stop for the sanding roller. To impart the necessary inclined position of a plurality of sanding elements 7 to the roller, an inner conversion element 4 is engaged with the collar 2 of the shaft, and then a plurality of spacer elements 6 is mounted, which will be explained more fully in connection with FIG. 3. Just after the mounting of these spacer elements 6 with respective sanding disks 7, the sanding roller is terminated with an outer conversion element 5, following which the individual sanding elements are secured effectively by tightening of the bolt 3.

In the shown embodiment the shaft 1 is cylindrical, so that this and the spacer elements 6 and the conversion elements 4 and 5 can expediently be provided with a plurality of axially extending fins and complementary grooves which together serve as a guide in the mounting of the individual spacer elements.

When the shaft is provided with e.g. a hexagonal cross-section and the elements 4–6 with corresponding holes, better properties are obtained with respect to carrying along the sanding disks, and the clamping will be less critical.

The starting material for making the sanding disks 7 will preferably be the rectangular sheet shown in FIG. 2A, which when slitted forms a plurality of lamellae 71 of substantially the same length and same shape which protrude perpendicularly from a continuous portion of material 72. The excentricity of the disks is provided by passing the continuous portion 72 of the sheet 70 around an eliptic mandrel, and then the shape of the resulting disk or rosette is fixed with a suitable binder, e.g. by fixing to a carrier disk 8 through the use of double-coated tape, hot-melt glue or the like. The disk 8 is preferably of plastics, but may optionally be formed as an annular rail of lightweight metal so that the sanding material 70 is fixed in the rail by clamping of it. In some cases the disk 8 may be omitted if the continuous portion 72 is gathered to a ring using a hot-melt plastics thread.

FIG. 2B shows a section of the sanding disk 7 with protruding lamellae 71, the disk 7 being secured to the carrier disk 8 which, owing to assembly on the sanding roller shown in FIG. 1, is formed with recesses 81 which can receive complementary fins or guide tracks on the spacer elements 6 shown in FIGS. 3A–3B on corresponding fins, extending longitudinally of the roller, on the intermediate pipe 45 shown in FIG. 4 or on the shaft portion 15 of increased diameter shown in FIG. 5.

The sanding roller of the invention is preferably cylindrical so that the inclined position of the disks makes it necessary that these are eliptic, the radius R of the roller corresponding to the minor axis b of the eliptic disks, while the major axis a may be expressed as a function of the inclined position $\phi$ of the disks and the diameter of the roller, $a=R/\cos\phi$, which gives the disk an excentricity $e=\sin\phi$.

As mentioned before, the shape of the disk is a result of the mandrel used in the shaping when the lamellae are of the same length. The mandrel, about which the slitted sheet 70 is placed, has an eliptic cross-section in the engagement area which depends upon the radius of the roller, the width of the slitted sheet and the inclined position of the disks.

FIGS. 3A and 3B illustrate the spacer element 6 shown in FIG. 1 which is formed with a through hole 62 to receive the shaft, where the hole 62 e.g. may be cylindrical or hexagonal The through hole 62 forms an angle with respect to the transverse faces on the element 6, thereby imparting to the disk 7 its inclined position. The spacer element 6 has a shoulder 65 intended for engaging the carrier disk 8 with the sanding disk 7. As will be seen, the mutual position of a plurality of guide tracks 66 and corresponding recesses 81 is ensured. The thickness of the portion 64 decides the density of sanding disks and thereby also the density of lamellae. The portion 63 is also to have a thickness such as to ensure that the carrier disk 8 placed on the shoulder 65 with mounted sanding disk is seated correctly and firmly fixed by clamping of the bolt 3 shown in FIG. 1. This may e.g. be achieved in that the carrier disk is elastic and the thickness of the carrier disk 8 and the sanding disk 7 is greater than the thickness of the portion 63. In addition, the spacer element is shaped such as to form a cylinder of revolution when assembled to a roller together with the inner and the outer conversion element 4, 5, so that the roller can rotate in a stable manner. To ensure the previously mentioned clamping of the carrier disk 8 and the sanding disk 7, an annular rubber ring 100 may be mounted in an annular recess 69 formed for this purpose on the spacer element 6.

FIG. 4 shows another embodiment of the sanding roller of the invention which has a number of points of resemblance with the preferred embodiment, but differs therefrom by having the inner conversion element 4 replaced by an intermediate pipe 45 extending in the axial direction of the axis. The intermediate pipe 45 and the axis 1 thus comprise cooperating means for maintaining the mutual position. Correspondingly, the intermediate pipe 45 may externally be formed with guide tracks which can cooperate with the previously mentioned recesses on the carrier ring 8 and the sanding disk 7. A spacer element 60 is mounted between successive sanding disks which ensures correct positioning. The outer conversion element 5 is replaced by a cap-like element 50. The length of the intermediate pipe 45 may advantageously be adapted such as to create a cavity 48 in an axial direction between the end face of the intermediate pipe 45 and the cap 50 upon clamping of the bolt 3. This ensures that the individual sanding disks will be retained correctly.

The embodiment of the sanding roller shown in FIG. 5 comprises a shaft 1 with a collar 20, where the part 22 adapted for mounting sanding disks 7 has a greater diameter than the rest of the shaft 1. An inner conversion element 46 engages with the collar 20, and then carrier disks 8, sanding disks 7 and spacer elements 60 are mounted alternately. The successively mounted number of sanding disks 7 are terminated with an outer conversion element 52 which, upon clamping with the bolt 3, forms a cavity 48 in an axial direction between the shoulder of the thickened part of the shaft 22 and the outer conversion element 52. As mentioned before, the shaft part 22 can advantageously comprise means for cooperation with the surrounding elements to ensure correct positioning.

In the preceeding embodiment the sanding disks are described as individual, i.e. only a single sanding disk is mounted between two spacer elements. However, the invention is not restricted to this, but the use of a single disk has a number of advantages over a double-disk since there will then be room for each individual lamella to turn freely when hitting the workpiece for working, e.g. a wood face. It is difficult for a lamella in a first part of a double-disk to turn when hitting an opposed lamella in the second part of the disk. When using abrasive cloth in a double-layer disk some of the lamellae will turn wrongly. A considerable part of the material commercially available will thus not be fit for use as a double-layered disk.

Lamellae in rollers composed of single-layered disks can turn freely since the roller is not as compact as a roller composed of double-layered disks and can therefore more easily work complex profiles. Further, there will be less wear on the sanding disk when it is used as a single-layered disk in a roller.

What is claimed is:

1. A method of making surface finishing or polishing rollers comprising disk-shaped surface finishing elements mounted successively on a spindle rotating in operation, each of said surface finishing elements being formed of a slitted, preferably rectangular sheet which has a portion of material continuous in one direction with lamellae protruding perpendicularly therefrom, characterized in that the slitted sheet is shape-fixed with binder by arranging the portion of material continuous in one direction over an oval mandrel where the periphery of the protruding lamellae therein forms an ellipse, and that a plurality of surface finishing elements, each comprising an oval disk with lamellae, are mounted inclined on the shaft of the spindle so that the contour of the successively mounted surface finishing elements is cylindrical in the axial direction of the spindle.

2. A surface finishing or polishing roller for use in the working of surfaces during which working the roller is simultaneously caused to rotate about a longitudinal axis thereof and to move in parallel with the surface being worked, characterized in that the surface finishing roller comprises a plurality of oval disk-shaped surface finishing elements (7) inclined about said longitudinal axis each of said finishing elements having an oval center ring and a plurality of lamellae extending outwardly therefrom.

3. A roller according to claim 2, characterized in that the individual elements (7) comprise oval, slitted surface finishing disks.

4. A roller as in one of claims 2 or 3, in which one side of the elements (7) is provided with abrasive.

5. A roller according to claim 4, characterized in that the successive elements (7) are mounted such that the sides provided with abrasive point in the same direction.

6. A roller according to claim 4, characterized in that the individual elements (7) are mounted on carrier disks (8) having one or more grooves to receive complementary guide fins in an axial direction on the surface of the roller (6, 22, 45).

7. A roller according to claim 4, characterized in that the shaft (1, 22) of the roller is formed with a polygonal cross-section.

* * * * *

UNITED STATES PATENT AND TRADEMARK OFFICE

CERTIFICATE OF CORRECTION

PATENT NO. : 5,008,993

DATED : April 23, 1991

INVENTOR(S) : Bent Malherbe

It is certified that error appears in the above-identified patent and that said Letters Patent is hereby corrected as shown below:

Col. 4, line 3, after "shaft" insert --1-- line 4, after "hexagonal" insert --period--

On the title page, Item [73] should read --

[73] Assignee: PanWood Ltd.
London, Great Britain --

Signed and Sealed this

Twenty-seventh Day of October, 1992

*Attest:*

DOUGLAS B. COMER

*Attesting Officer*

*Acting Commissioner of Patents and Trademarks*